US009036837B2

(12) United States Patent
Tuomy et al.

(10) Patent No.: US 9,036,837 B2
(45) Date of Patent: May 19, 2015

(54) DESKTOP AUDIO MONITOR SYSTEM AND METHOD

(76) Inventors: James Tuomy, Framingham, MA (US); Barry Michael Kosherick, Hudson, MA (US); Laurie Wilk, Framingham, MA (US); J. Richard Aylward, Ashland, MA (US)

( * ) Notice: Subject to any disclaimer, the term of this patent is extended or adjusted under 35 U.S.C. 154(b) by 468 days.

(21) Appl. No.: 12/802,993

(22) Filed: Jun. 17, 2010

(65) Prior Publication Data

US 2011/0235838 A1 Sep. 29, 2011

Related U.S. Application Data

(60) Provisional application No. 61/268,964, filed on Jun. 18, 2009.

(51) Int. Cl.

| | |
|---|---|
| ***H04R 9/06*** | (2006.01) |
| ***H04R 1/34*** | (2006.01) |
| *H04R 1/26* | (2006.01) |

(52) U.S. Cl.
CPC . *H04R 1/345* (2013.01); *H04R 1/26* (2013.01)

(58) Field of Classification Search
USPC ..... 381/71.7, 160, 305, 333, 352
See application file for complete search history.

(56) References Cited

U.S. PATENT DOCUMENTS

| | | | | |
|---|---|---|---|---|
| 3,573,399 | A * | 4/1971 | Schroeder et al. | 381/92 |
| 4,031,318 | A * | 6/1977 | Pitre | 381/386 |
| 4,190,739 | A * | 2/1980 | Torffield | 381/305 |
| 4,475,620 | A * | 10/1984 | Carlsson | 181/146 |
| 4,701,951 | A * | 10/1987 | Kash | 381/304 |
| 4,800,983 | A * | 1/1989 | Geren | 181/155 |
| 4,939,703 | A * | 7/1990 | Muller | 367/140 |
| 5,250,763 | A * | 10/1993 | Brown | 181/155 |
| 5,485,521 | A * | 1/1996 | Yagisawa et al. | 381/160 |
| 6,349,792 | B1 * | 2/2002 | Smith et al. | 181/156 |
| 7,184,562 | B2 * | 2/2007 | Seki et al. | 381/160 |
| 7,296,653 | B1 * | 11/2007 | Smith et al. | 181/155 |
| 7,760,895 | B1 * | 7/2010 | Lehmann | 381/160 |
| 2002/0097886 | A1 * | 7/2002 | Maruo | 381/182 |
| 2002/0118858 | A1 * | 8/2002 | White et al. | 381/430 |
| 2004/0190746 | A1 * | 9/2004 | Seki et al. | 381/388 |
| 2006/0109989 | A1 * | 5/2006 | Linhard | 381/160 |
| 2007/0223710 | A1 * | 9/2007 | Laurie et al. | 381/56 |
| 2008/0159570 | A1 * | 7/2008 | Hung et al. | 381/160 |
| 2008/0165991 | A1 * | 7/2008 | Shyu et al. | 381/160 |
| 2008/0247575 | A1 * | 10/2008 | Hutt et al. | 381/302 |
| 2009/0175469 | A1 * | 7/2009 | Kondo et al. | 381/152 |

(Continued)

FOREIGN PATENT DOCUMENTS

| | | | | |
|---|---|---|---|---|
| JP | 63036699 | A * | 2/1988 | H04R 1/34 |

*Primary Examiner* — David S. Warren

(57) ABSTRACT

A desktop audio loudspeaker system, for placement on a desktop used a work surface by a listener, includes an enclosure for placement on or above the desktop, the enclosure having a front surface; a first loudspeaker mounted in the enclosure, the first loudspeaker radiating sound from the enclosure, past the front surface, in a direct path to ears of the listener. This embodiment also includes a first reflective element having a surface, the first reflective element mounted in relation to the enclosure so as to reduce multipath effects caused by reflection of sound by the desktop, wherein the surface of the first reflective element is disposed transversely with respect to the front surface of the enclosure, and forming an angle with the front surface, to reflect sound, emanating from the first loudspeaker, away from the desktop in a direction that avoids a direct path to ears of the listener.

18 Claims, 14 Drawing Sheets

(56) References Cited

U.S. PATENT DOCUMENTS

2010/0158287 A1* 6/2010 Xu et al. ..... 381/300
2010/0272295 A1* 10/2010 Nakatani ..... 381/160
2011/0194719 A1* 8/2011 Frater ..... 381/332
2011/0235838 A1* 9/2011 Tuomy et al. ..... 381/333

* cited by examiner

Figure 1 -Prior Art

Figure 2 - Prior Art

Figure 3 – Prior Art

Figure 4 - Measurement of Prior Art

DESKTOP AUDIO MONITOR SYSTEM AND METHOD

The present application claims the benefit of provisional application Ser. No. 61/268,964, filed Jun. 18, 2009, entitled Acoustic Shadow Stand.

TECHNICAL FIELD

The present invention relates to audio loudspeaker systems, and more particularly to desktop audio monitors.

BACKGROUND ART

With the evolution of the personal computer to near Main Frame power, Personal CAD/CAM workstations have become de rigueur in almost every industry. One of the last industries to be effected is the music and audio-for-video production business.

The past decade has seen huge strides in both computing power and cost effectiveness of audio workstations. At the same time, traditional business models for entities involved in the creation of music and sound for profit have been almost completely replaced. The new model for music production might involve a capital equipment outlay of under $30,000.00. In 1980 that figure would have been at least $1 Million.

Along with the change in business model has come a change in the audio monitoring set-ups that are used by the creative professional to judge the quality and consistency of the audio recordings that are in the process of being turned into finished works:

In the pre-workstation days of audio production, monitor loudspeakers could be expected to be around 6 to 12 feet away from the persons responsible for audio quality. These persons were generally seated behind an array of audio control systems referred to as a "mixing desk" or "console". The mixing desk was used as a sort of routing and processing system to enable the creation of a polished, finished audio recording. The creative people seated at the desk were the Producer (who calls the creative shots) and the Engineer who operates the entire system and tries to satisfy the Producer's creative needs.

The monitor loudspeakers for this sort of set up were (and are) generally mounted high on the wall beyond the mix console, and are usually tilted down and toed in to the best listening angle. Monitors so arrayed are often considered as "near field", though the listeners are actually well into the reverberant field of the room.

In creating the "Virtual Mixing Desk" inherent in any computerized music production system, audio monitoring has thus far received very little attention. First of all, financial constraints have tended to eliminate the Engineer. These days the producer has both the operational and creative roles. Second, top quality audio component design engineers do not think of a computer monitor as being the central piece of an audio editing system. However, in the case of an audio workstation, the producer/engineer is absolutely tethered to one to three computer monitors flanked by small high quality loudspeakers.

All of these items are generally placed on a single ordinary business desk, with the monitor speakers sometimes place on a shelf at the rear of the desk.

SUMMARY OF EMBODIMENTS

In a first embodiment of the invention there is provided a method of improving performance of a desktop loudspeaker system of the type having a loudspeaker in an enclosure for placement on or above a desktop used as a work surface by a listener, the enclosure having a front surface, the loudspeaker radiating sound from the enclosure, past the front surface, in a direct path to ears of the listener. In this embodiment, the method includes providing a reflective element having a surface; mounting the reflective element in relation to the enclosure so as to reduce multipath effects caused by reflection of sound by the desktop. These effects are reduced by causing the surface of the reflective element to be disposed transversely with respect to the front surface of the enclosure, and forming an angle with the front surface, to reflect sound, emanating from the loudspeaker, away from the desktop in a direction that avoids a direct path to ears of the listener. In this manner, relatively little sound reaches the desktop to be reflected thereby and sound that is reflected by the reflective element lacks a direct path to ears of the listener and is thus attenuated and delayed when it does reach the ears of the listener.

In a further related embodiment, the reflective element contains at least one diffusion element. Optionally, the reflective element is disposed at an acute angle relative to the front surface. In one further related embodiment, the acute angle is approximately 80 degrees.

In another related embodiment, the reflective element is disposed at an obtuse angle relative to the front surface, and in one further embodiment, the obtuse angle is approximately 120 degrees.

In another embodiment, there is provided a desktop audio loudspeaker system, for placement on a desktop used a work surface by a listener. In this embodiment, the system includes an enclosure for placement on or above the desktop, the enclosure having a front surface; a first loudspeaker mounted in the enclosure, the first loudspeaker radiating sound from the enclosure, past the front surface, in a direct path to ears of the listener. The embodiment also includes a first reflective element having a surface, the first reflective element mounted in relation to the enclosure so as to reduce multipath effects caused by reflection of sound by the desktop, wherein the surface of the first reflective element is disposed transversely with respect to the front surface of the enclosure, and forming an angle with the front surface, to reflect sound, emanating from the first loudspeaker, away from the desktop in a direction that avoids a direct path to ears of the listener. In this manner relatively little sound reaches the desktop to be reflected thereby and sound that is reflected by the first reflective element lacks a direct path to ears of the listener and is thus attenuated and delayed when it does reach the ears of the listener.

In a further related embodiment, the first reflective element forms a part of the enclosure and is disposed between the first loudspeaker and the desktop. Optionally, the first reflective element contains at least one diffusion element. Alternatively or in addition, the first reflective element is disposed at an acute angle relative to the front surface. In a further related embodiment, the acute angle is approximately 80 degrees.

In another related embodiment, the first reflective element is disposed at an obtuse angle relative to the front surface. In a further related embodiment, the obtuse angle is approximately 120 degrees.

In yet another related embodiment, the system further includes a targeting ring mounted over the first loudspeaker for use by the listener in visually evaluating spatial orientation of the system in relation to the listener, wherein indication of optimal orientation occurs when the listener observes the center of the first loudspeaker within the center of the targeting ring.

In a further related embodiment, there is included a second loudspeaker mounted in the enclosure, the second loudspeaker radiating sound from the enclosure, past the front surface, in a direct path to ears of the listener, the second loudspeaker radiating in a frequency range different from a frequency range of the first loudspeaker. This embodiment also includes a second reflective element having a surface, the second reflective element mounted in relation to the enclosure so as to reduce multipath effects caused by reflection of sound by the desktop, wherein the surface of the second reflective element is disposed transversely with respect to the front surface of the enclosure, and forming an angle with the front surface, to reflect sound, emanating from the second loudspeaker, away from the desktop in a direction that avoids a direct path to ears of the listener. In this fashion relatively little sound reaches the desktop to be reflected thereby and sound that is reflected by the second reflective element lacks a direct path to ears of the listener and is thus attenuated and delayed when it does reach the ears of the listener.

In a further related embodiment, the first reflective element forms a part of the enclosure and is disposed between the first loudspeaker and the desktop, and the second reflective element forms a part of the enclosure and is disposed between the second loudspeaker and the desktop.

In yet another embodiment, the second loudspeaker is a tweeter and is mounted to have an angle of radiation that is adjustable in a vertical plane.

BRIEF DESCRIPTION OF THE DRAWINGS

The foregoing features of the embodiments will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

A "desktop" is a surface that is approximately, but not necessarily exactly, horizontal and employed as a work surface.

Figure 1:
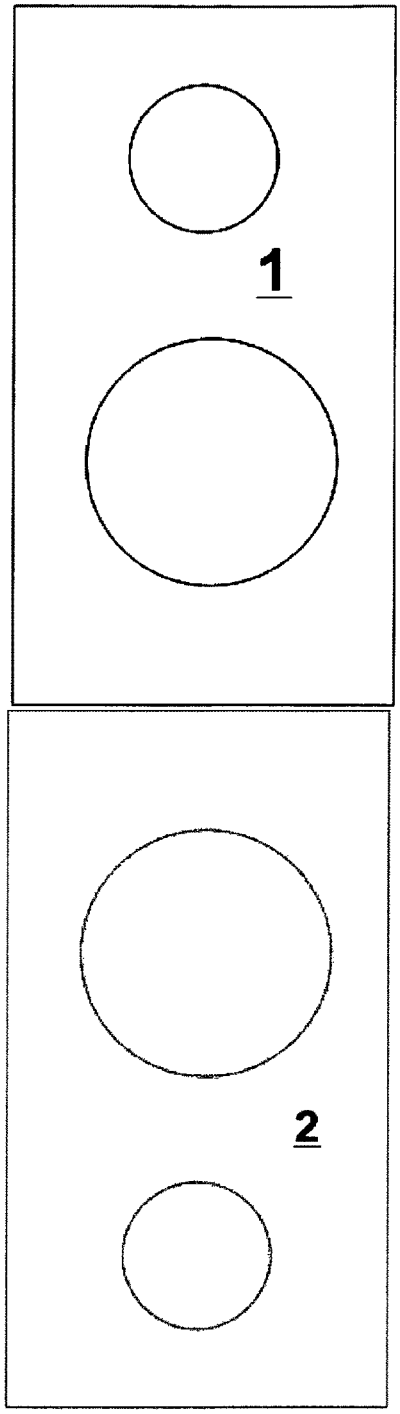
FIG. 1 is a diagram of a prior art loudspeaker system 1 and its acoustic reflection 2 when placed directly on a flat surface.

We have discovered that placing a small loudspeaker over a flat surface very near the listener (like a desk) can have very serious unintended consequences:

FIG. 1 is a diagram of a prior art loudspeaker system 1 and its acoustic reflection 2 when placed directly on a flat surface. It can be seen that a small loudspeaker placed directly on a desk will create an audible "phantom" 2 which will behave as if it were a second audio source placed beneath the desk in mirror image.

Figure 2:
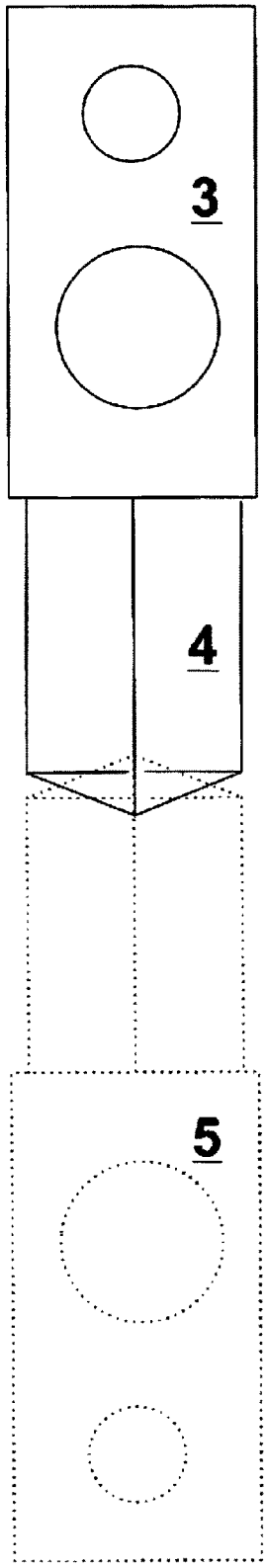
FIG. 2 is a diagram of a prior art loudspeaker system 3 and its acoustic reflection 5 when on a stand 4 on a flat surface.

FIG. 2 is a diagram of a prior art loudspeaker system 3 and its acoustic reflection 5 when on a stand 4 on a flat surface. As illustrated in this figure, placing the loudspeaker on a small stand usually six to eight inches high seems at first to improve unwanted frequency response problems slightly but in fact worsens them, because the reflective effect is exacerbated.

Figure 3:
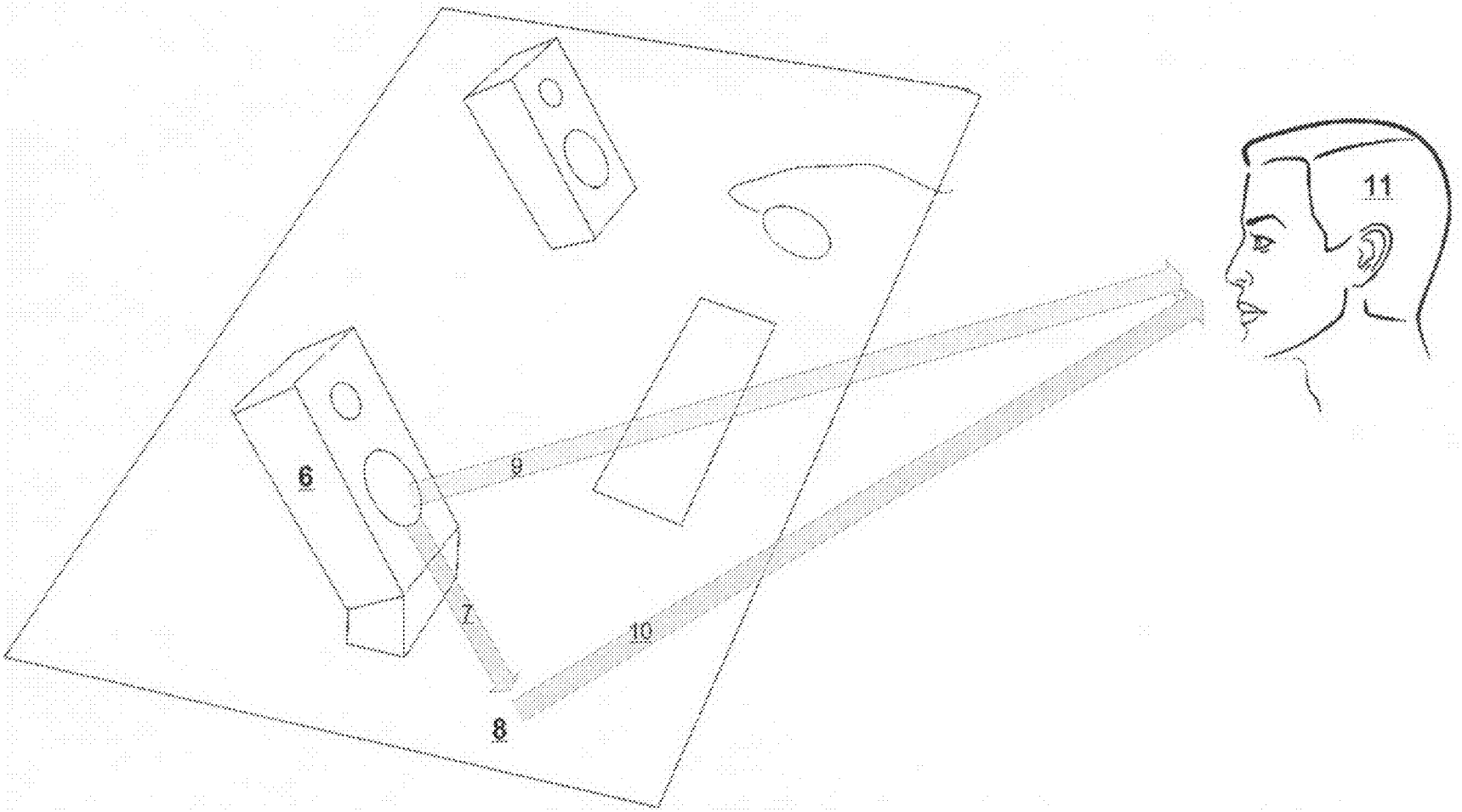
FIG. 3 is a diagram of another prior art loudspeaker system that is both elevated and tilted.

FIG. 3 is a diagram of another prior art loudspeaker system that is both elevated and tilted, showing the direct path 9 from the loudspeaker 6 and the reflected path 10 off the desktop surface 8 originating from the of the loudspeaker via path 7 to the listener's ear 11. As illustrated in FIG. 3, any time a loudspeaker is operated while placed on or near an acoustically reflective surface much larger than itself, such as a desk, kitchen counter, or table, a listener positioned near the speaker and above and in front of the surface will hear both the speaker directly over path 9 and a slightly delayed acoustic reflection along path 10.

Figure 4:
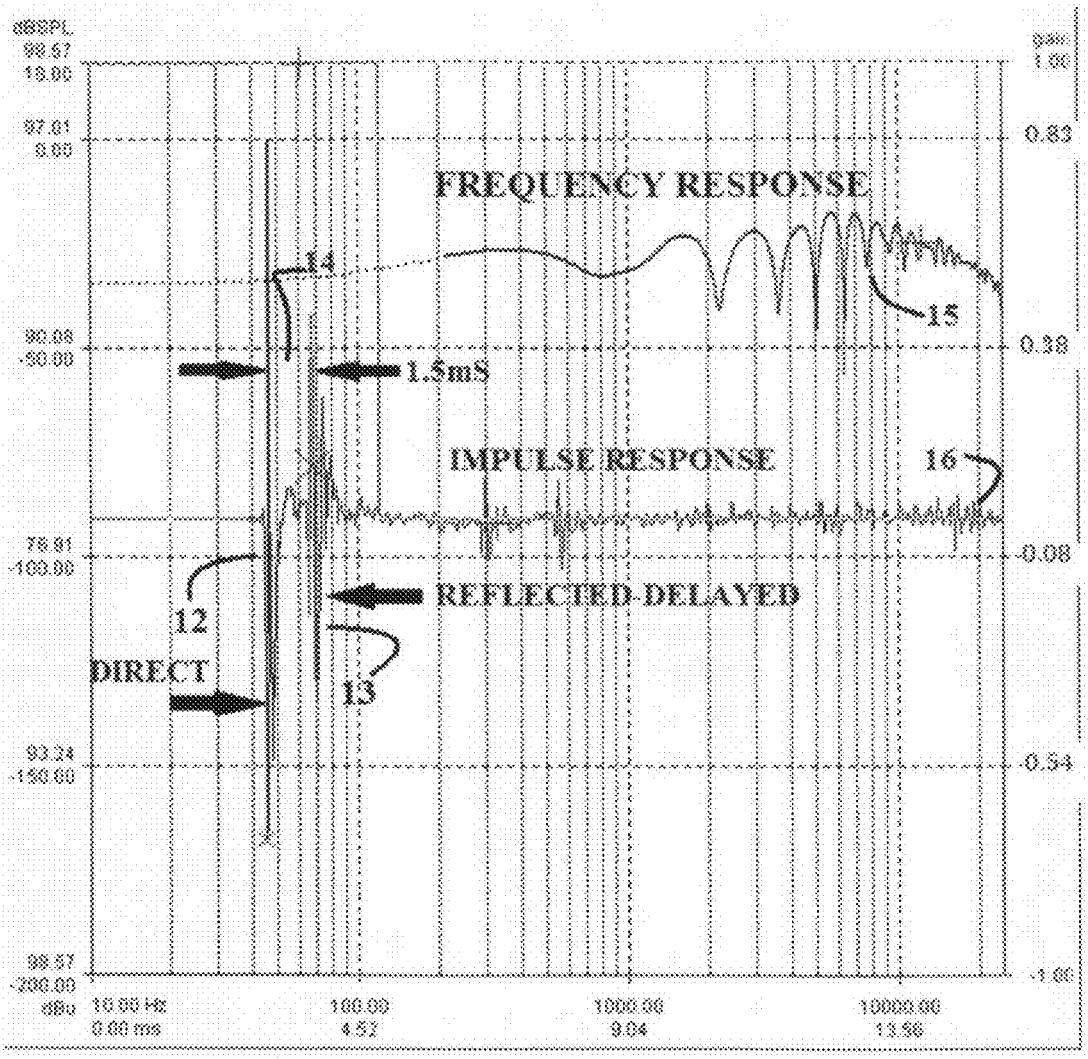
FIG. 4 is a graph of measurements, associated with the prior art system of FIG. 3.

FIG. 4 is a graph of measurements, associated with the prior art system of FIG. 3, showing the arrivals of the audio energy traveling along the direct path 12 from the loudspeaker and the audio energy traveling along the reflected path 13 off the surface without use of the reflective element of the acoustic shadow stand. The direct and acoustic reflection sounds arrive within a short time interval 14. Because the arrival time window is within human hearing's integration time, a comb-filter 15 results. Item 15 of FIG. 4 is an actual FFT derived frequency response taken from the impulse response 16.

Because the human hearing mechanism presents an "integration time" of less than 5 mS, any two acoustic events arriving at the ear within that time window, and the interval 14 of FIG. 4 is within such a window, will be added together (integrated) as if they were one acoustic event.

When a sound stream is integrated with a slightly delayed copy of itself, the result is a series of harmonically related filters whose depth is related to the relative levels of the direct and delayed streams. This form of filter series is usually called a "comb filter", which is illustrated as item 14 of FIG. 4. To a listener, the effects of the comb filter, caused by the integration of sound directly from the loudspeaker and sound reflected by the desk, include: 1) an apparent, albeit not actual, increase of loudness of sounds in the high frequency portion of the audio spectrum; 2) distortion of sound causing listener fatigue; and 3) for the audio professional, inaccurate perception of the character of recorded sound that impairs judgment of how to make mixing and other signal processing decisions.

As discussed, if a reflected copy of a direct sound arrives at the listener's ear after a delay of less than around 5 mS or so the "copy" sound will be integrated with the direct sound by the listener's hearing. On the other hand, if the arrival time difference between direct and delayed copy sound is greater than around 10 ms, the listener's ear/brain will perceive the reflected sound as a separate acoustic event and will effectively mask it.

So the general approach of embodiments of this invention is 1) to increase the delay time of otherwise early reflections that would otherwise come from the desktop so that any reflection of sound is perceived as separate from the undelayed source; and 2) to create conditions wherein the acoustic level of the reflected sound is reduced in comparison to the level of sound that would be reflected from the desk.

Figure 5:
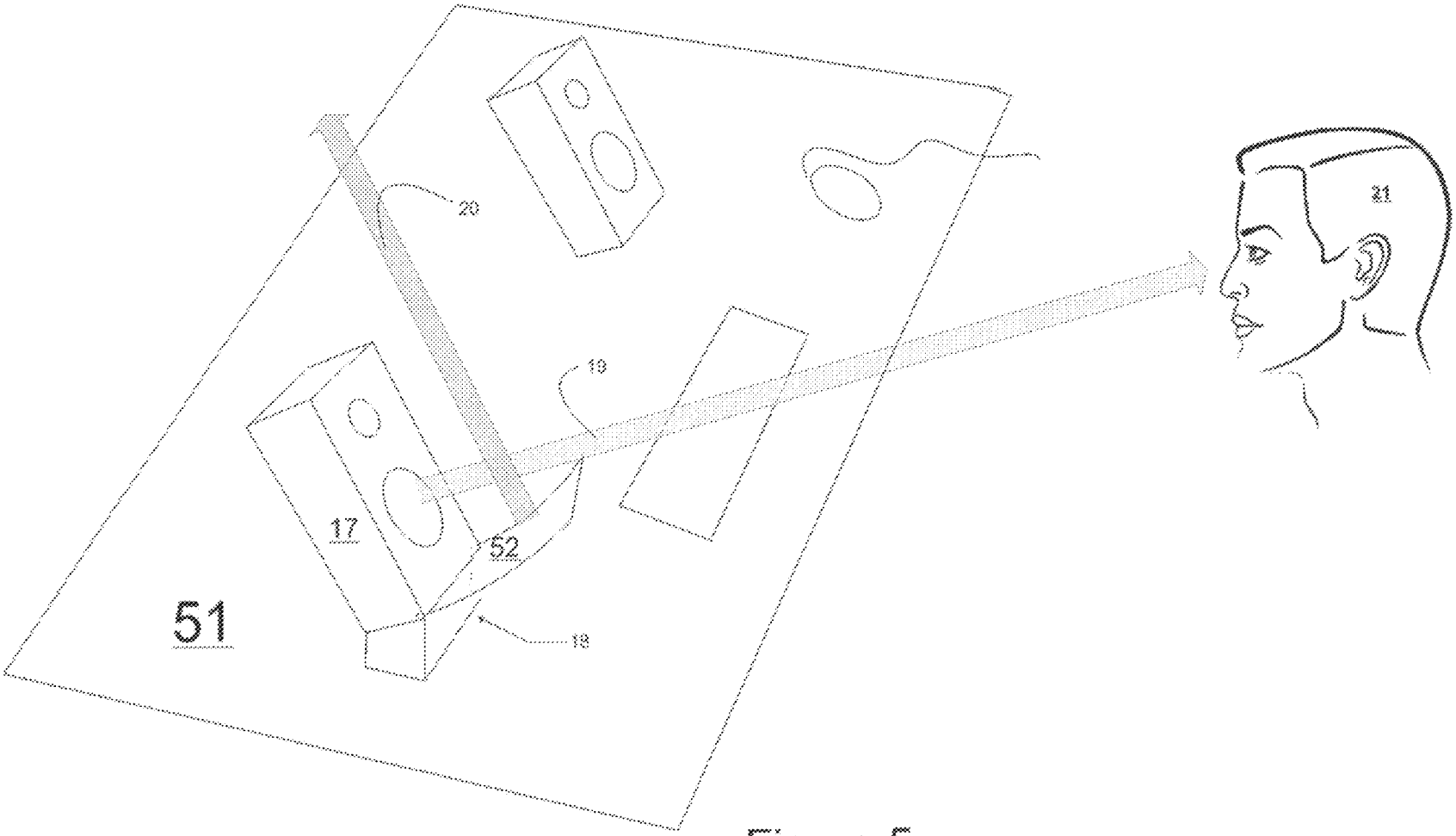
FIG. 5 a diagrammatic view of an embodiment of the present invention, employing an acoustic shadow stand.

FIG. 5 is a diagrammatic view of an embodiment of the present invention, taking advantage of the approach just described. In this embodiment, the acoustic shadow stand 18 largely prevents sound emanating from the loudspeaker 20 from being reflected by the desk 51, because the reflective element 52 redirects sound that would otherwise be reflected by the desk into a direction, along path 20, that is above and behind the loudspeaker 17 while allowing the sound along direct path 19 from the loudspeaker 17 to travel unimpeded to the listener's ear 21. Moreover, because the path to the listener's ear for sound initially reflected by the reflective element 52 is much longer than the path that would result from reflection by the desk 51, sound initially reflected by the reflective element 52 is much diminished in level upon finally reaching the listener's ear by virtue of both room attenuation and the inverse square law of sound attenuation over distance. The attenuation of reflected sound may optionally be further augmented by use of standard acoustic attenuation materials such as foam and fiberglass.

The orientation of the reflective element 52 is important. Let us imagine momentarily that the reflective element 52 is a mirror. If the listener in working position relative to the desk can see the surface of the reflective element 52, and if the listener can see a reflection of the loudspeaker by looking at this surface (assuming that it is a mirror) then (because the ears of the listener are in generally the same position as the eyes of the listener) the listener can also hear sound reflected by the reflective element 52, and, as we have described previously, it is undesirable for the listener to hear reflections that arrive with so little delay compared to the direct radiation. Accordingly it is important to orient the reflective element to prevent such reflection and therefore to cause reflection away from a direct path to ears of the listener. We have found that, in typical embodiments, the reflective element forms an angle with the face of the speaker enclosure of somewhat under 90 degrees, for example, 80 degrees. In other embodiments, however, the angle can be greater than 90 degrees, for example 120 degrees, with the effect (illustrated in FIG. 14) of preventing reflection from the desk and of reflecting sound to the abdomen of the listener and still away from ears of the listener.

Figure 6:
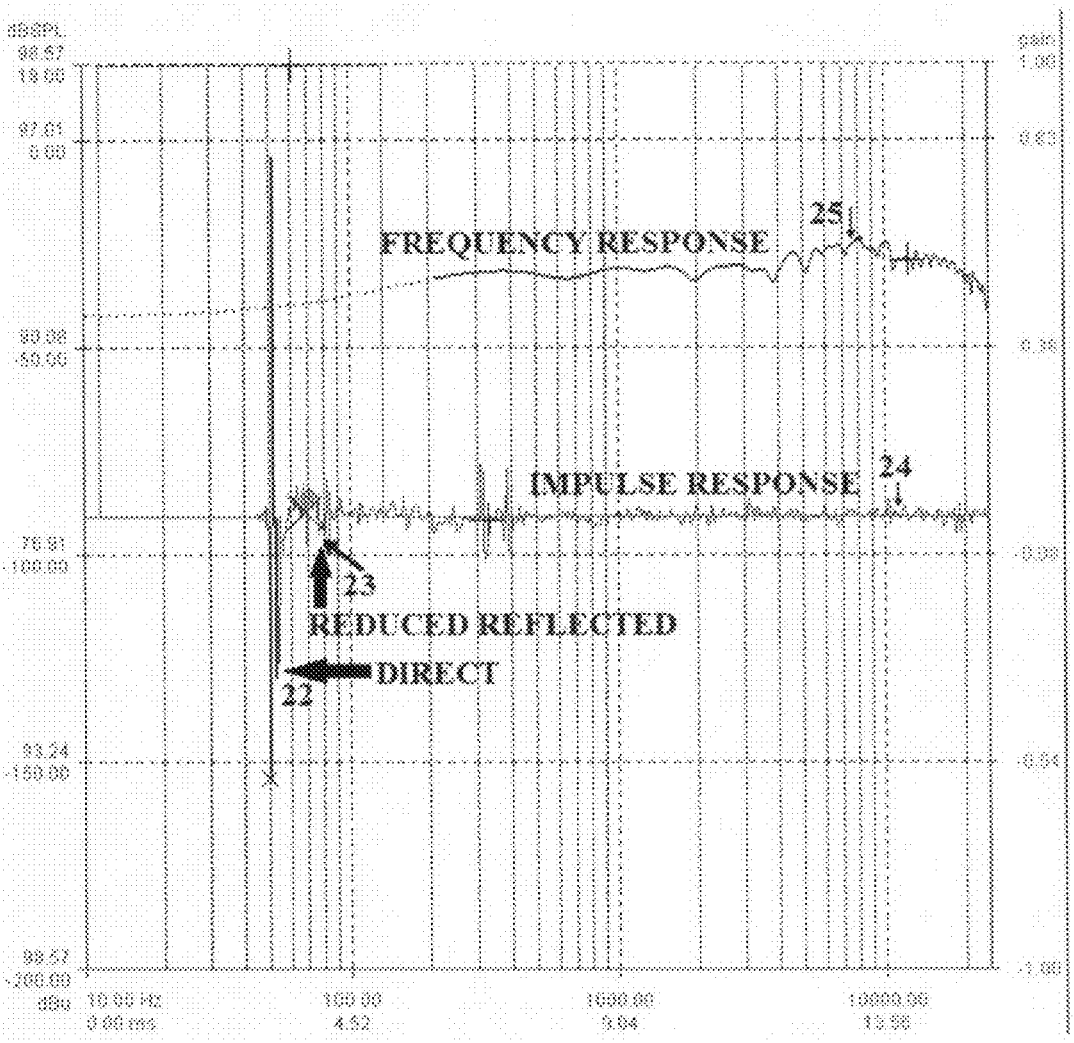
FIG. 6 is a graph of measurements, associated with the embodiment of FIG. 5, showing effects of the addition of the reflective element of the acoustic shadow stand.

FIG. 6 is a graph of measurements, associated with the embodiment of FIG. 5, showing effects of the addition of the reflective element of the acoustic shadow stand in allowing only the audio energy traveling along the direct path 19 to reach the listener's ear. Item 22 of FIG. 6 is the measurement of the direct impulse arriving at the listener's ear, item 23 of FIG. 6 is the measurement of the much reduced reflected impulse, and item 25 of FIG. 6 is the FFT frequency response derived from the Impulse response 24, which exhibits greatly reduced comb filtering.

Figure 7:
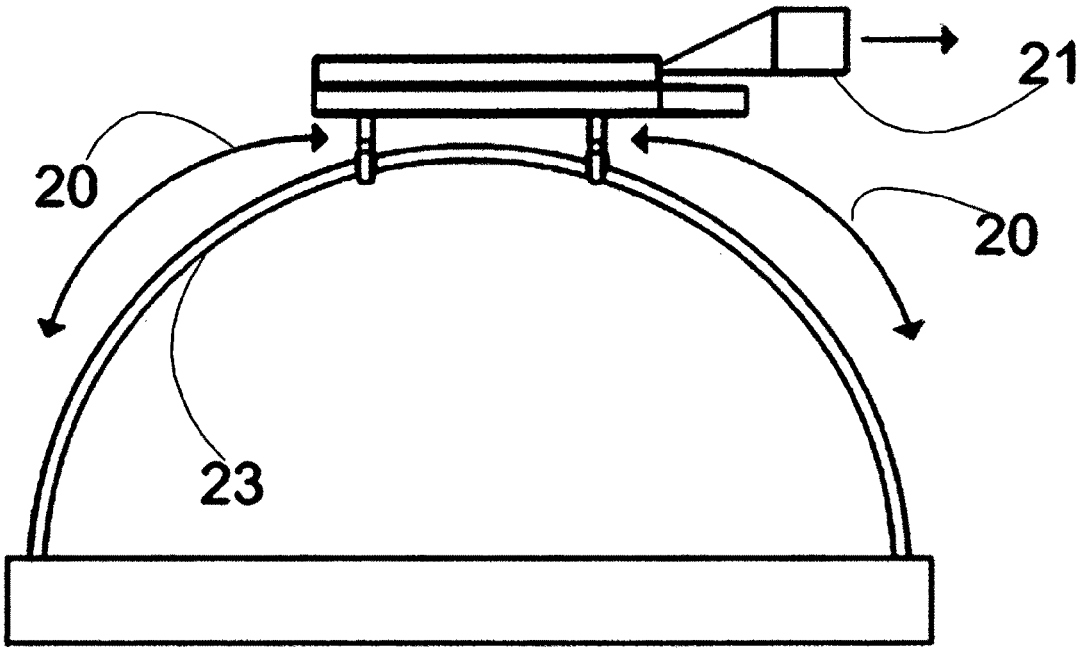
FIG. 7 is a left side view of an embodiment of the present invention.

FIG. 7 is a left side view of an embodiment of the present invention showing movement for the pitch adjustment 20 and the movement for adjustment of the shield 21 for different sizes of loudspeaker.

Figure 8:
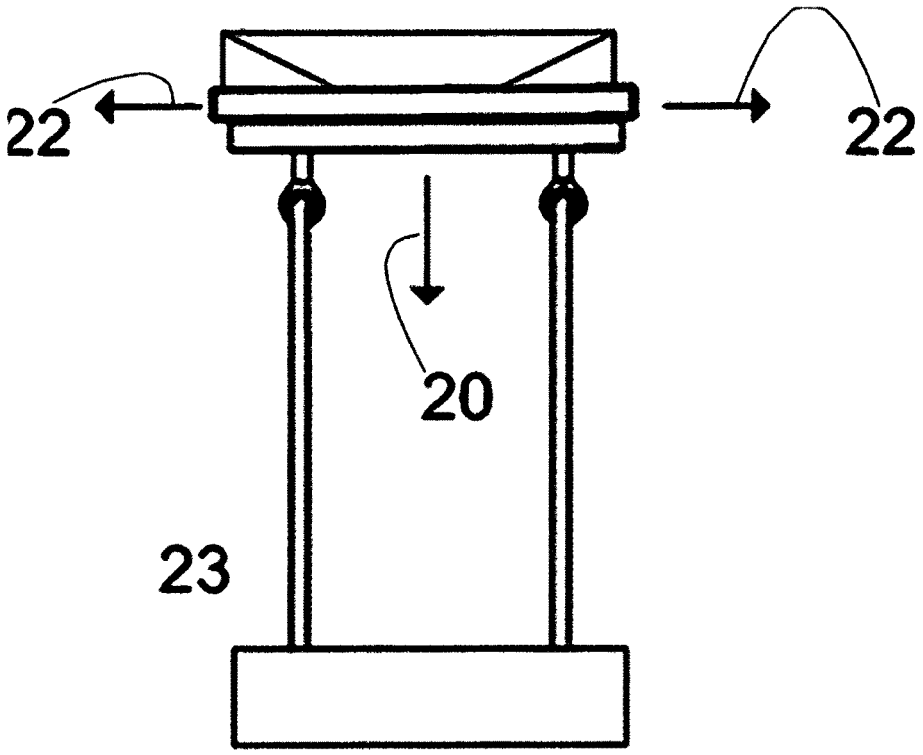
FIG. 8 is a back view of the embodiment of FIG. 7.

FIG. 8 is a back view of the embodiment of FIG. 7, showing the pitch 20 and azimuth 22 movements.

Figure 9:
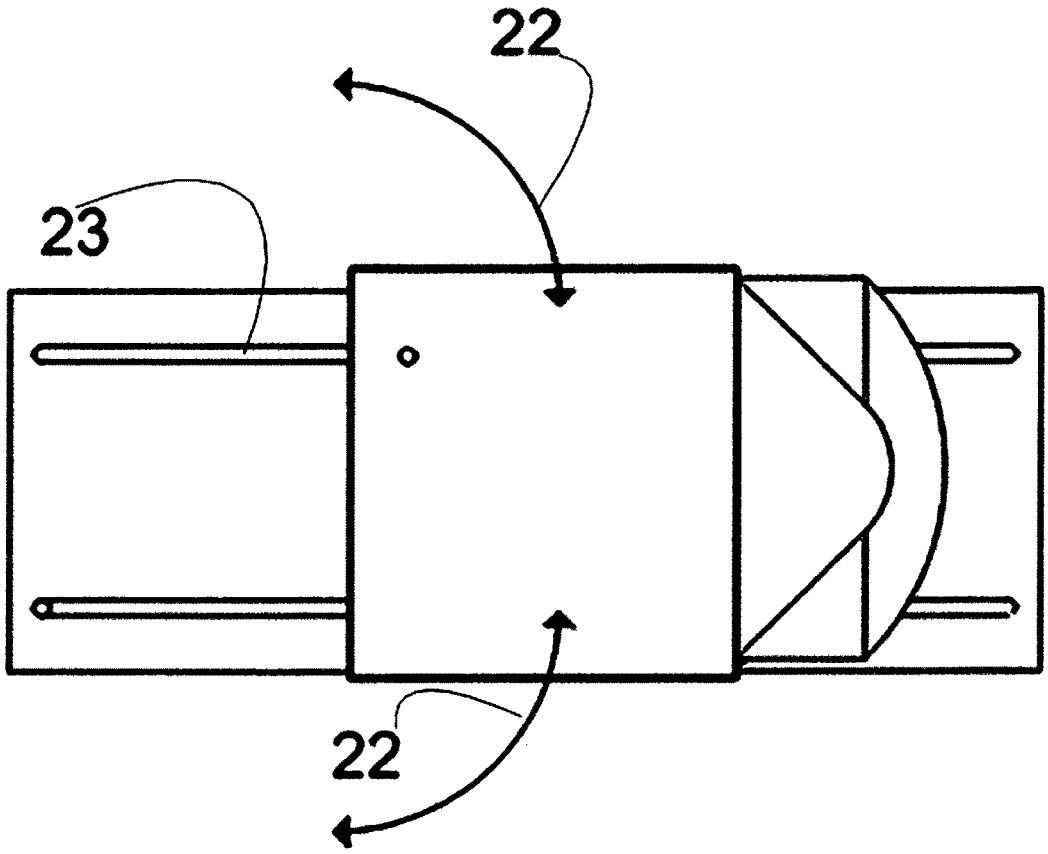
FIG. 9 is a top view of the embodiment of FIG. 7.

FIG. 9 is a top view of the embodiment of FIG. 7, showing the movement for azimuth 22 adjustment.

Figure 10:
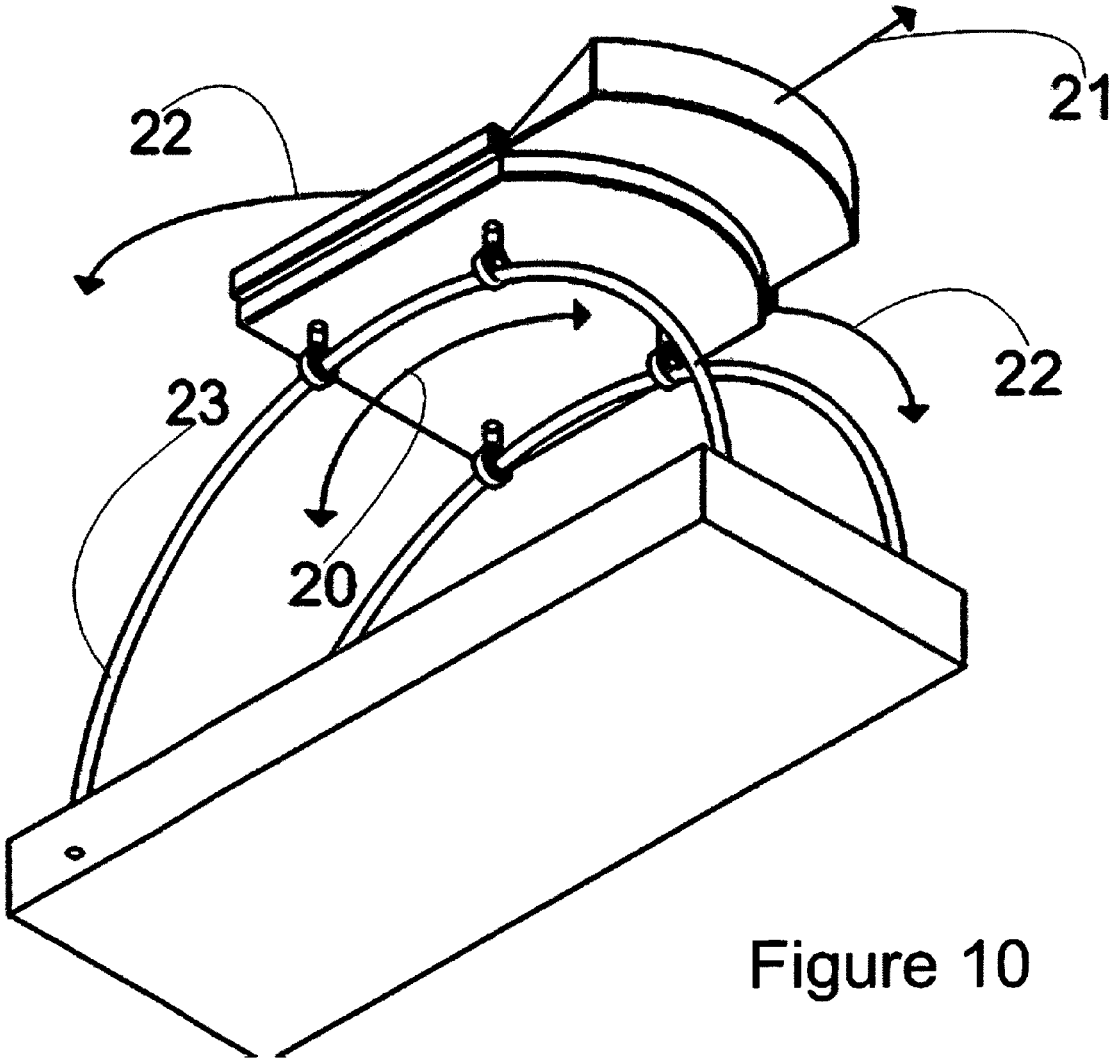
FIG. 10 is an isometric view of the embodiment of FIG. 7.

FIG. 10 is an isometric view of the embodiment of FIG. 7, showing the movement for azimuth 22 and pitch 20 adjustment and the movement for shield size adjustment 21.

Figure 11:
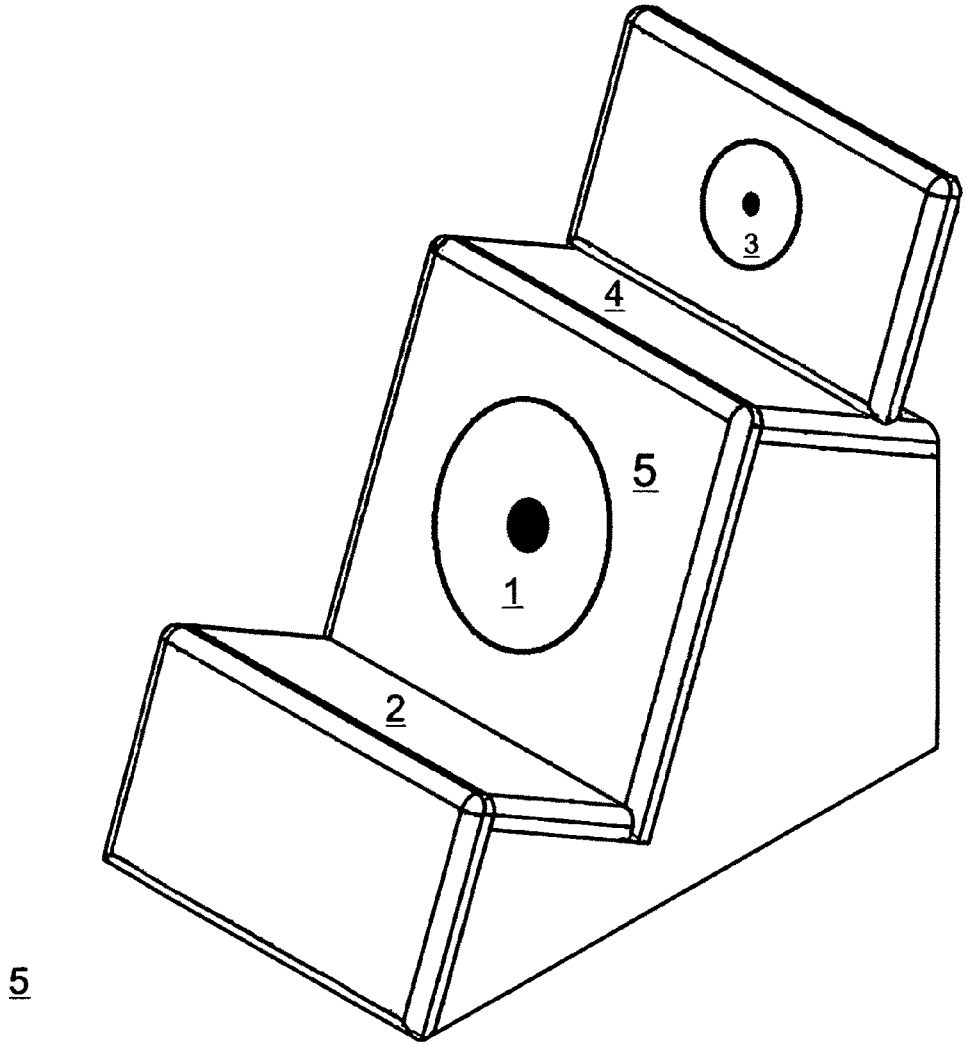
FIG. 11 is a view of another embodiment of the present invention, wherein a single enclosure provides both (i) conventional baffling of the speaker to prevent energy from the rear of the speaker from reaching the front and (ii) suppression of reflection of the energy from the front of the speaker from the desktop.
Figure 14:
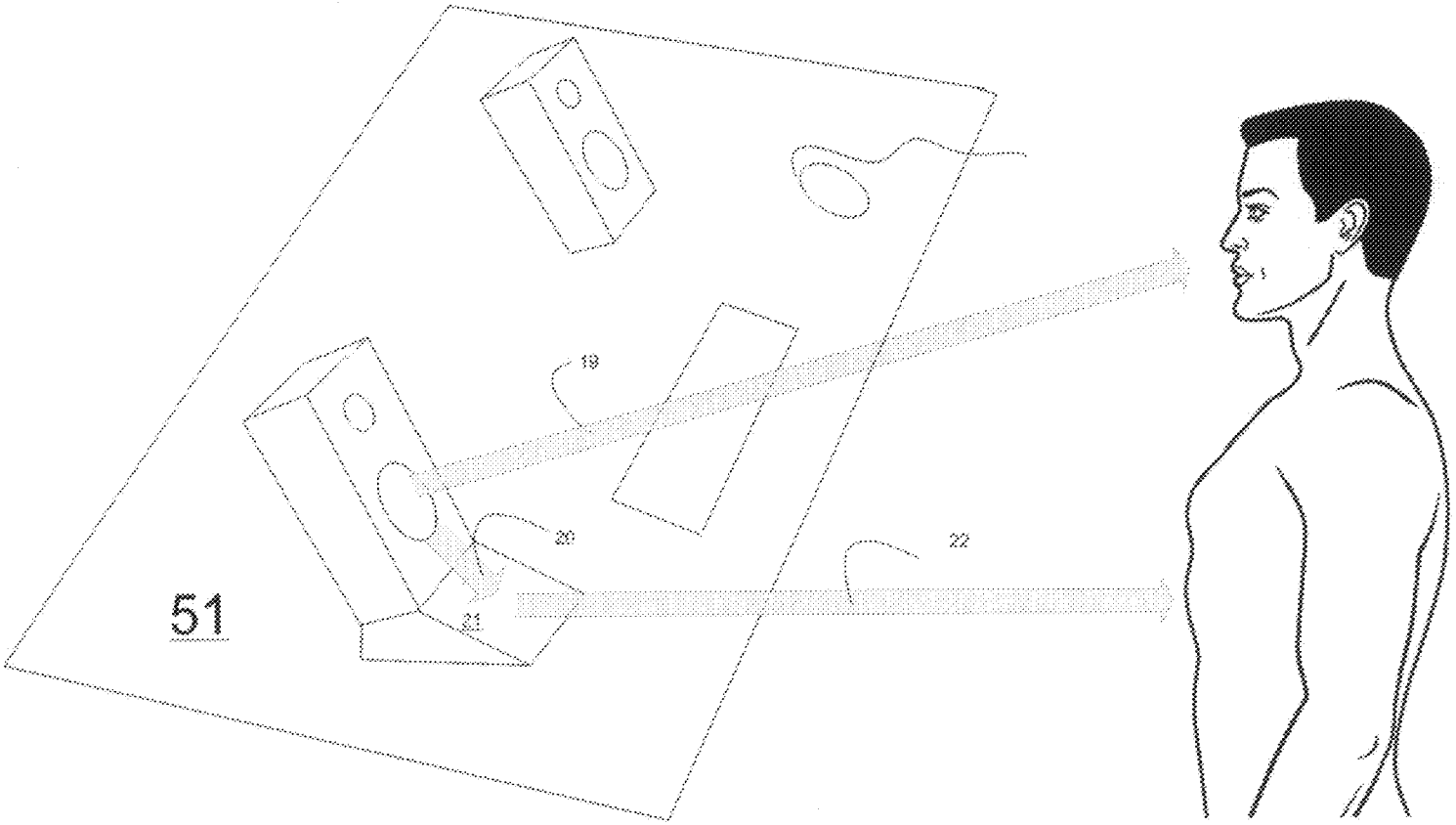
FIG. 14 is a view of another embodiment of the present invention, wherein the reflective element is angled at approximately 120 degrees relative to the main baffle.

FIG. 11 is a view of another embodiment of the present invention, wherein a single enclosure provides both (i) conventional baffling of the speaker to prevent energy from the rear of the speaker from reaching the front and (ii) suppression of reflection of the energy from the front of the speaker from the desktop. In this embodiment, the reflections from the desk of energy from the woofer 1 and tweeter or mid-tweeter section 2 are suppressed separately by use of reflective elements 2 and 4 respectively. It can be seen, should it be desired, that one of the two speaker sections, for example, the section including the tweeter or mid-tweeter 3, can be eliminated. Performance of the embodiment of FIG. 11 is analogous to the performance of the embodiment of FIG. 5, with the further benefit that the reflective elements 2 and 4 may here conveniently be made more rigid, since they form a part of the enclosure for the system. In the embodiment of FIG. 11, we have illustrated the surfaces of the reflective elements at approximately 80 degrees relative to the front surface of the enclosure, in a manner analogous to the embodiment of FIG. 5. However, as discussed in connection with FIG. 5, other angles are possible, such as, for example, approximately 120 degrees as depicted in FIG. 14.

Experimentally, the embodiment of FIG. 11 has proven to provide a very smooth and aesthetically pleasing sonic character. The two reflective elements act to diffuse the sound in the playback environment because they "cast" the would-be near field reflections to other points in the room that are more distant from the listener than the desktop. As a result, their effect on the room acoustics is the same as if a great deal of diffusion had been added to the environment.

Figure 12:
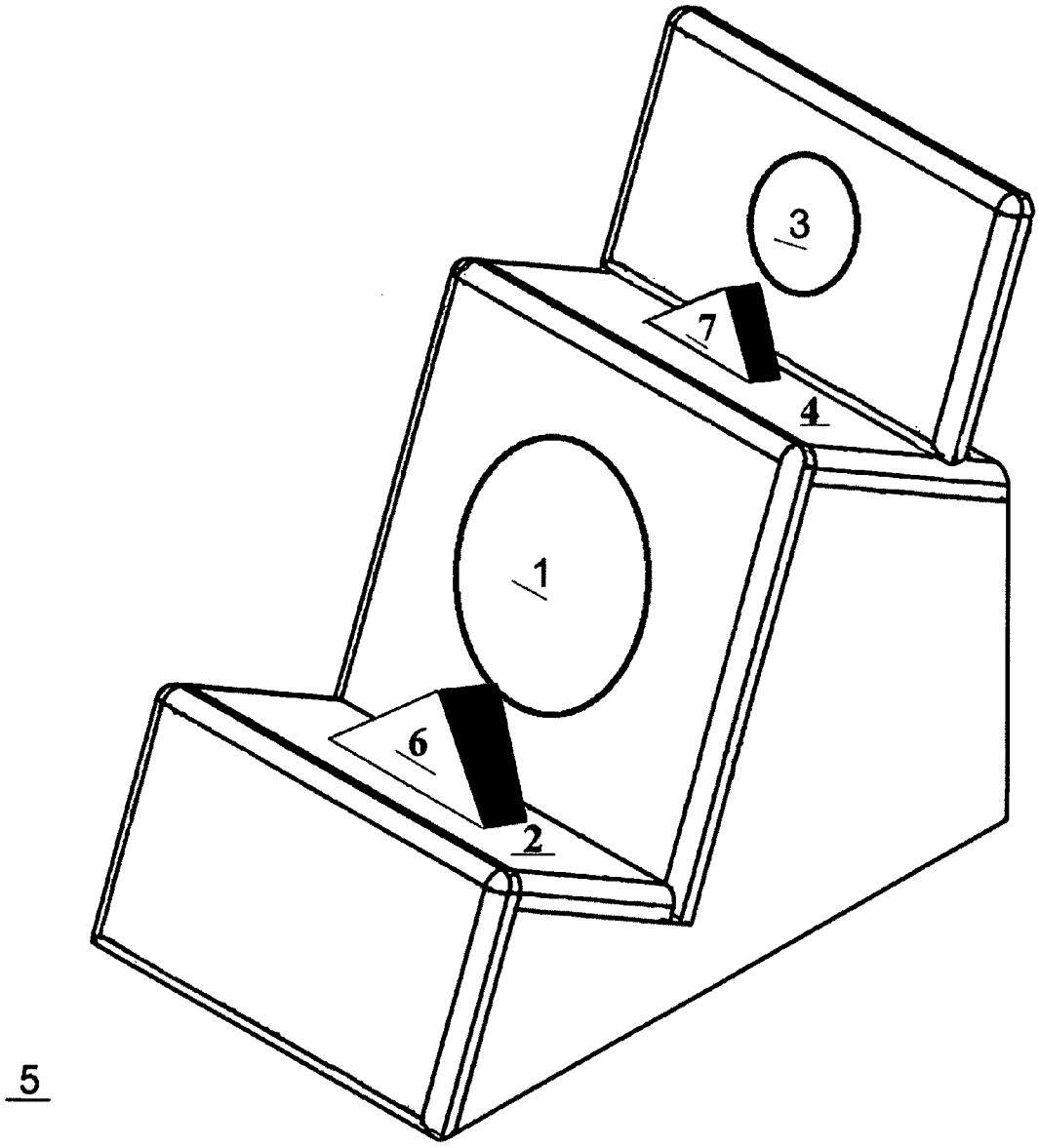
FIG. 12 is a view of another embodiment of the present invention, wherein diffusive elements have been added to the reflective elements of FIG. 11

FIG. 12 depicts an embodiment of the present invention, similar to the embodiment of FIG. 11, in which diffusive properties of the reflective elements (discussed above in connection with FIG. 11) have been deliberately enhanced through the addition of diffusion elements 6 and 7. The diffusion elements 6 and 7 are here shown in the shape of an extruded triangle, with the hypotenuse engaged in each case with the reflective element 2 and 4 respectively. The shape of the diffusion elements 6 and 7 dramatically increases diffusion of near-field reflected sound. In particular, the diffusion elements will reduce dependency of the system on room acoustics to achieve reduction of intensity of the sound reflected by the reflective elements 2 and 4, because they transform what otherwise would be specular reflection into highly diffuse reflection. The diffusion elements 6 and 7 have the experimental effect of making this embodiment effective in reducing adverse acoustical effects caused by location of the system in a small room, where reflection from low ceilings and near walls can harm the listening experience. Although the diffusion elements 6 and 7 are shown as extruded triangles, a wide variety of other shapes may produce satisfactory diffusion. For example, one may use a series of irregularly spaced shapes placed on the reflective elements 2 and 4.

Suitable implementations may be achieved, for example, with binary diffusers and quadratic root diffusers. Exponential and linear sided cone shapes may also be used effectively.

The loudspeakers employed in the embodiments of FIGS. 11, 12, 13, and 14 are suitably implemented as cardioid radiators to reduce adverse affects attributable to rearward radiation that would be reflected off of nearby walls or other surfaces.

With the effective reduction of reflections from loudspeaker systems in accordance with embodiments of the present invention, the direct radiation of sound from the systems becomes much more important. In this respect, the spatial orientation of the listener in relation to the loudspeaker system is correspondingly important, because the distribution of radiation from the loudspeaker system is at least somewhat directional, and also at least somewhat dependent upon the distance from loudspeaker to listener, particularly in the higher frequencies.

Accordingly in a further embodiment of the present invention, there is provided an arrangement for assuring, over an indefinite period of time, the repeatability in spatial orientation of the listener in relation to the loudspeaker system. The creation of audio program material nearly always involves some process of editing to refine or combine raw recorded materials in order to create a polished finished product. One of the more important considerations is that within a given work or section of a work the overall character of the sound must remain constant. As an example, when dialog captured on a busy street corner has to be spot-corrected or replaced after the fact, it is essential that the background street noise playing under the dialog appears to be uninterrupted in the corrected finished material. Similarly, when the process of mixing and editing an audio program takes more than one work day, it is essential that the sonic character of the in-process work remains constant from each day to the next. In professional audio and video circles this day-today consistency is called "continuity".

The only way a person working with audio at a desktop can guarantee audio continuity is to be certain that listening conditions are repeatable. As we discuss in the previous paragraph repeatability of listening conditions becomes even more important when undesired reflections from the loudspeaker system are removed, because under such conditions the geometry of the loudspeaker system in relation to the listener will substantially affect the listening experience. Embodiments of the present invention guarantee the substantial repeatability of the listener experience by enabling the establishment of substantially the same spatial orientation of the listener in relation to the loudspeaker system in terms of the distance and angle of the loudspeaker system in relation to the user.

Figure 13:
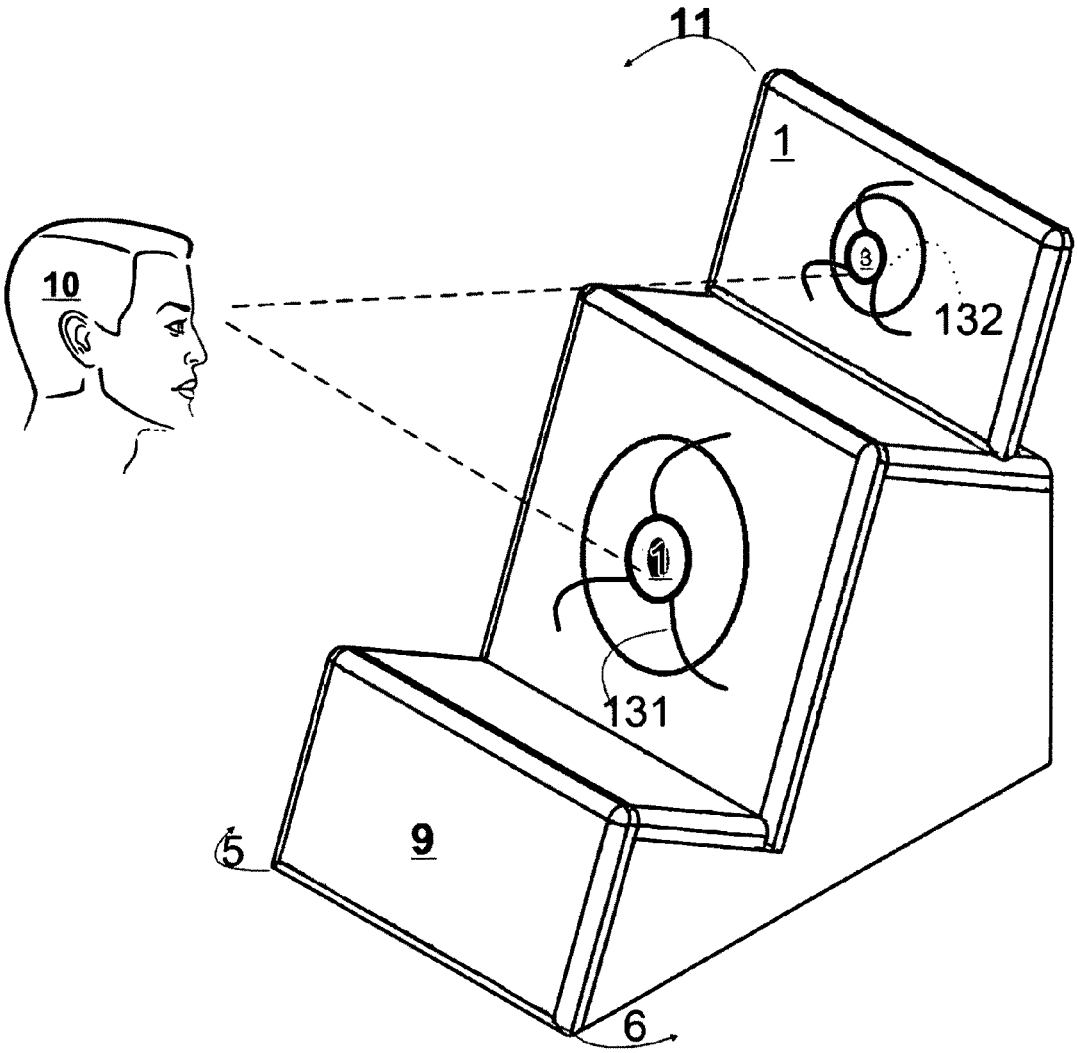
FIG. 13 is a view of another embodiment of the present invention, wherein user targeting elements have been added to the front baffle of FIG. 11 to provide exact acoustic repeatability on a session-to-session or day-to-day or user-to-user basis.

Accordingly, an embodiment of the present invention, illustrated in FIG. 13, provides a targeting system to insure precise session-to-session matching of position and angle of the user relative to any number of desktop or stand-mounted speakers arrayed around the user in a specific setup for a given project. Each loudspeaker of the system illustrated in FIG. 13, namely the woofer 1 and the tweeter 3, is fitted with a visual targeting ring, identified as 131 (for the woofer 1) and 132 (for the tweeter 3). The visual targeting ring enables the listener to determine alignment of the speaker system.

For left-to-right centering, the listener can conveniently use the targeting ring 131 associated with the woofer 1. If the woofer is fitted with a cone-shaped phase plug at its center, the apex of the cone provides a convenient visual reference for the center of the woofer that can be used by the listener in orienting the woofer in relation to the targeting ring 131. If the woofer lacks a phase plug, it may be equipped with a visual marker to identify the center point of the woofer. The listener moves the system to the left in direction 5 or to the right in direction 6 in order to adjust left-to-right centering of the woofer. In addition, the distance between the listener and the system may also be adjusted so that the vertical position of the center of the woofer is in the center of the targeting ring 131. Because the user's eyes and ears are located above the desktop and above the woofer, there is only a single distance along the desk at which the center of the woofer is in the center of the targeting ring 131.

After the system is positioned to assure proper location of the woofer 1, the listener may also adjust the angle of the tweeter 3 relative to the rest of the system in order to cause the tweeter to radiate directly at the height of the user's ears when the user is seated. The user knows that that the tweeter 3 has been tilted forward correctly when the center of the tweeter 3 appears to be exactly centered in the tweeter targeting ring 132. Again, f the tweeter is fitted with a cone-shaped phase plug at its center, the apex of the cone provides a convenient visual reference for the center of the tweeter that can be used by the listener in orienting the tweeter in relation to the targeting ring 132. If the tweeter lacks a phase plug, it may be equipped with a visual marker to identify the center point of the tweeter.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A method of improving performance of a desktop loudspeaker system of the type having a loudspeaker in an enclosure for placement on or above a desktop used as a work surface, the work surface defining a horizontal plane, by a listener, who is positioned in front of the desktop and facing it in a manner that ears of the listener are positioned above the horizontal plane, the enclosure having a front surface, defining a front plane of the enclosure, the listener facing the front plane of the enclosure and wherein when the enclosure has been placed on or above the desktop, the loudspeaker radiates sound from the enclosure, past the front surface, principally in a direction generally normal to the front plane and in a direct path to ears of the listener thus positioned, the method comprising:

providing a reflective element having a surface; and mounting the reflective element in relation to the enclosure, between the first loudspeaker and the desktop, so as to reduce multipath effects caused by reflection of sound by the desktop, by causing the surface of the reflective element to be disposed transversely with respect to the front plane of the enclosure, and forming an angle with the front plane, to reflect sound, emanating from the loudspeaker, that impinges on the surface of the reflective element, away from the desktop in a direction that avoids a direct path to ears of the listener, so that relatively little sound reaches the desktop to be reflected thereby and sound that is reflected by the reflective element lacks a direct path to ears of the listener and is thus attenuated and delayed when it does reach the ears of the listener.

2. A method according to claim 1, wherein the reflective element contains at least one diffusion element.

3. A method according to claim 1, wherein the reflective element is disposed at an acute angle relative to the front surface.

4. A method according to claim 3, wherein the acute angle is approximately 80 degrees.

5. A method according to claim 1, wherein the reflective element is disposed at an obtuse angle relative to the front surface.

6. A method according to claim 5, wherein the obtuse angle is approximately 120 degrees.

7. A desktop audio loudspeaker system, for placement on or above a desktop used as a work surface, the work surface defining a horizontal plane, by a listener, positioned in front of the desktop in a manner that ears of the listener are positioned above the horizontal plane, the system comprising:

an enclosure for placement on or above the desktop, the enclosure having a front surface defining a front plane of the enclosure; and a first loudspeaker mounted in the enclosure, wherein the enclosure and loudspeaker are configured so that when the enclosure is positioned on or above the desktop and the listener faces the front plane, the first loudspeaker radiates sound from the enclosure, past the front surface, principally in a direction generally normal to the front plane and in a direct path to ears of the listener thus positioned; and a first reflective element having a surface, the first reflective element mounted in relation to the enclosure, between the first loudspeaker and the desktop, so as to reduce multipath effects caused by reflection of sound by the desktop, wherein the surface of the first reflective element is disposed transversely with respect to the front plane of the enclosure, and forming an angle with the front plane, to reflect sound, emanating from the first loudspeaker, that impinges on the surface of the reflective element, away from the desktop in a direction that avoids a direct path to ears of the listener, so that relatively little sound reaches the desktop to be reflected thereby and sound that is reflected by the first reflective element lacks a direct path to ears of the listener and is thus attenuated and delayed when it does reach the ears of the listener.

8. A system according to claim 7, wherein the first reflective element forms a part of the enclosure.

9. A system according to claim 7, wherein the first reflective element contains at least one diffusion element.

10. A system according to claim 7, wherein the first reflective element is disposed at an acute angle relative to the front surface.

11. A system according to claim 10, wherein the acute angle is approximately 80 degrees.

12. A system according to claim 7, wherein the first reflective element is disposed at an obtuse angle relative to the front surface.

13. A system according to claim 12, wherein the obtuse angle is approximately 120 degrees.

14. A system according to claim 7, further comprising a targeting ring mounted over the first loudspeaker for use by the listener in visually evaluating spatial orientation of the system in relation to the listener, wherein indication of optimal orientation occurs when the listener observes the center of the first loudspeaker within the center of the targeting ring.

15. A system according to claim 7, further comprising:

a second loudspeaker mounted in the enclosure, the second loudspeaker radiating sound from the enclosure, past the front surface, principally in a direction generally normal to the front plane and in a direct path to ears of the listener thus positioned, the second loudspeaker radiating in a frequency range different from a frequency range of the first loudspeaker;

a second reflective element having a surface, the second reflective element mounted in relation to the enclosure, between the second loudspeaker and the desktop, so as to reduce multi path effects caused by reflection of sound by the desktop, wherein the surface of the second reflective element is disposed transversely with respect to the front plane of the enclosure, and forming an angle with the front plane, to reflect sound, emanating from the second loudspeaker, that impinges on the surface of the second reflective element, away from the desktop in a direction that avoids a direct path to ears of the listener, so that relatively little sound reaches the desktop to be reflected thereby and sound that is reflected by the second reflective element lacks a direct path to ears of the listener and is thus attenuated and delayed when it does reach the ears of the listener.

16. A system according to claim 7, wherein the first reflective element forms a part of the enclosure and is disposed between the first loudspeaker and the desktop, and the second reflective element forms a part of the enclosure and is disposed between the second loudspeaker and the desktop.

17. A system according to claim 7, wherein the second loudspeaker is a tweeter and is mounted to have an angle of radiation that is adjustable in a vertical plane.

18. A system according to claim 7, wherein the first element is positioned so that sound reflected by the first element is delayed by at least about 10 ms.

* * * * *